US012326049B2

(12) United States Patent
Kaipov et al.

(10) Patent No.: US 12,326,049 B2
(45) Date of Patent: Jun. 10, 2025

(54) COMBINATION OF A SURFACE WELL TESTING FACILITY AND A CABLE FORMATION TESTER WITH AN ACTIVE CIRCULATION SYSTEM FOR OBTAINING INFLOW AND MEASURING FORMATION FLUID PARAMETERS ON THE SURFACE

(71) Applicant: Schlumberger Technology Corporation, Sugar Land, TX (US)

(72) Inventors: Yermek Kaipov, Dhahran (SA); Yakov Dzhalatyan, Moscow (RU); Mikhail Charupa, Dhahran (SA); Hadrien Dumont, Paris (FR); Bertrand Claude Theuveny, Paris (FR); Abilkassym Kishauov, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/698,805

(22) PCT Filed: Oct. 12, 2022

(86) PCT No.: PCT/US2022/046366
§ 371 (c)(1),
(2) Date: Apr. 5, 2024

(87) PCT Pub. No.: WO2023/064325
PCT Pub. Date: Apr. 20, 2023

(65) Prior Publication Data

US 2024/0401422 A1 Dec. 5, 2024

(30) Foreign Application Priority Data

Oct. 12, 2021 (RU) ..... RU2021129613

(51) Int. Cl.
*E21B 49/08* (2006.01)
*E21B 21/06* (2006.01)
*E21B 49/10* (2006.01)

(52) U.S. Cl.
CPC ..... *E21B 21/067* (2013.01); *E21B 49/087* (2013.01); *E21B 49/10* (2013.01)

(58) Field of Classification Search
CPC ..... E21B 49/10; E21B 49/087; E21B 49/088
See application file for complete search history.

(56) References Cited

U.S. PATENT DOCUMENTS

2010/0217575 A1* 8/2010 Briers ..... E21B 43/14 703/10
2011/0198078 A1* 8/2011 Harrigan ..... E21B 49/087 166/254.2

(Continued)

*Primary Examiner* — Giovanna Wright
(74) *Attorney, Agent, or Firm* — Jeffrey D. Frantz

(57) ABSTRACT

Methods and systems for conveying a WFT via drill pipe within a wellbore penetrating a subterranean formation and setting two packers of the WFT on opposite sides of a zone of interest of the formation, thereby isolating an interval of an annulus between the WFT and a wall of the wellbore. DTT of the formation is then performed by operating two WFT pumps of the WFT to pump fluid from the formation via the isolated interval, through the WFT, and out of the WFT to the wellbore, while operating mud pumps to pump drilling mud into the wellbore and thereby convey a mixture of the drilling mud and the pumped formation fluid through the annulus to a mud gas separator. Gas from the mud gas separator is used to measure a surface production rate of the formation fluid.

5 Claims, 5 Drawing Sheets

(56) References Cited

U.S. PATENT DOCUMENTS

| | | | | |
|---|---|---|---|---|
| 2012/0279702 | A1* | 11/2012 | Bedouet | E21B 49/08 166/250.03 |
| 2014/0311737 | A1* | 10/2014 | Bedouet | E21B 49/10 166/264 |
| 2018/0119547 | A1* | 5/2018 | Slapal | E21B 21/10 |
| 2021/0231012 | A1* | 7/2021 | Jones | E21B 49/081 |

* cited by examiner

COMBINATION OF A SURFACE WELL TESTING FACILITY AND A CABLE FORMATION TESTER WITH AN ACTIVE CIRCULATION SYSTEM FOR OBTAINING INFLOW AND MEASURING FORMATION FLUID PARAMETERS ON THE SURFACE

CROSS-REFERENCE TO RELATED APPLICATIONS

This application is a National Stage Entry of International Patent Application No. PCT/US2022/046366, filed Oct. 12, 2022, which claims priority to and the benefit of Russian Patent application Ser. No. 2021129613, filed Oct. 12, 2021.

BACKGROUND OF THE DISCLOSURE

As the production of oil and gas in major regions has been declining, exploration efforts are shifting towards hard-to-reach, understudied areas lacking sufficient infrastructure. Moreover, hydrocarbon fields that are being explored today often have more complex geological structure than those discovered decades ago and are characterized by the presence of multiple reservoirs with individual fluid contacts. The above-mentioned factors significantly increase the time it takes to test these reservoirs and estimate their production potential.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces a method that includes conveying a wireline formation tester (WFT) via drill pipe within a wellbore penetrating a subterranean formation and setting two packers of the WFT on opposite sides of a zone of interest of the formation, thereby isolating an interval of an annulus between the WFT and a wall of the wellbore. Deep transient testing (DTT) of the formation is then performed by operating two WFT pumps of the WFT to pump fluid from the formation via the isolated interval, through the WFT, and out of the WFT to the wellbore, while operating mud pumps to pump drilling mud into the wellbore and thereby convey a mixture of the drilling mud and the pumped formation fluid through the annulus to a mud gas separator located at a wellsite surface from which the wellbore extends. Gas separated by the mud gas separator is used to measure a surface production rate of the formation fluid.

The present disclosure also introduces a method that includes utilizing a wellbore dynamics simulation to simulate liquid and gas behavior in a wellbore during a contemplated DTT of a subterranean formation penetrated by the wellbore. The contemplated DTT utilizes a WFT in the wellbore and a three-phase separator at a wellsite surface from which the wellbore extends. The simulated liquid and gas behavior in the wellbore includes during shut-in periods of the DTT and during drilling mud circulation periods of the DTT. Results of the wellbore dynamics simulation are utilized to estimate fluid migration velocity in the wellbore with and without drilling mud circulation, as well as mud column hydrostatic pressure behavior along the wellbore at any moment of the test. A job design for the contemplated DTT is optimized based on the wellbore dynamics simulation results, the estimated fluid migration velocity, and the estimated mud column hydrostatic pressure behavior. The contemplated DTT is then performed simultaneously utilizing the WFT to pump fluid from the formation, utilizing mud pumps at the wellsite surface to pump drilling mud into the wellbore and thereby pump a mixture of the formation fluid and the drilling mud to the three-phase separator, and measuring gas rate obtained from the three-phase separator.

The present disclosure also introduces a system for performing DTT of a subterranean formation penetrated by a wellbore. The system includes a WFT conveyable in the wellbore via drill pipe and operable to pump formation fluid from the formation during the DTT. The system also includes a multiphase flowmeter located at a wellsite surface from the wellbore extends and operable to measure gas flow rate of a fluid mixture output from the wellbore during the DTT.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
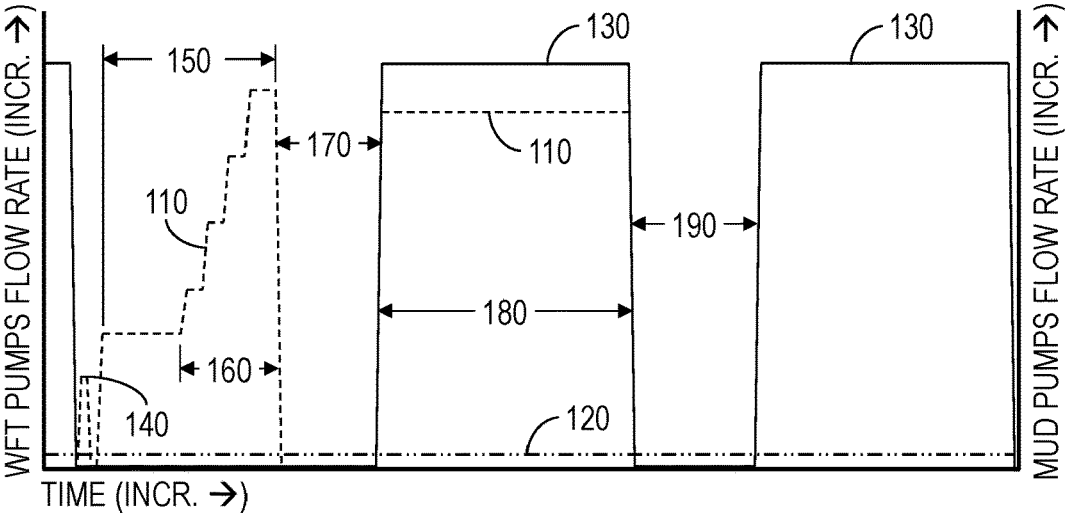
FIG. 1 is a schematic view of at least a portion of an example implementation of a DTT sequence according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Furthermore, terms, such as upper, upward, above, lower, downward, and/or below are utilized herein to indicate relative positions and/or directions between apparatuses, tools, components, parts, portions, members and/or other elements described herein, as shown in the corresponding figures. Such terms do not necessarily indicate relative positions and/or directions when actually implemented. Such terms, however, may indicate relative positions and/or directions with respect to a wellbore when an apparatus according to one or more aspects of the present disclosure is utilized or otherwise disposed within the wellbore. For example, the terms upper and upward may mean in the uphole direction, and the terms lower and downward may mean in the downhole direction.

Gains in operational efficiency is a challenge faced by the oil and gas industry. Conventional well testing conducted in cased wells is a significant step in a well construction cycle and is an effective and reliable method to prove reservoir saturation and estimate its deliverability. However, with declines in production in major oil and gas provinces, exploration activity is shifting toward remote, difficult-to-access regions having harsh climate conditions and lacking sufficient infrastructure, which hinder well testing. The Gydan Peninsula, which holds many large but understudied gas condensate fields, is an example of such regions. Well testing in such areas is slowed by the fact that a substantial portion of the hydrocarbons are located in complex, multi-layered, Lower and Upper Cretaceous reservoirs with multiple fluid contacts.

The present disclosure introduces employing a WFT, such as the ORA WFT offered by SCHLUMBERGER of Houston, Texas, in conjunction with a surface-located, multiphase flowmeter. For example, the ORA WFT permits pumping a volume of fluid from a subterranean reservoir that is an order of magnitude larger than the volume possible with traditional WFT/DFA (wireline formation tester/downhole fluid analysis) systems, thus permitting estimates of the permeability of the reservoir (including in the "uninvaded zone" not altered by drilling fluid) and the productivity of the reservoir, as well as surface-measured flow rates and surface-captured samples of the fluids pumped from the reservoir. Such capabilities make these surveys similar to conventional well tests, but where such surveys can be carried out in a fraction of the time of traditional well testing.

Moreover, surveys conducted according to aspects introduced in the present disclosure can be utilized for testing low-permeability formations, including to obtain information about saturation and productivity with the capability of the acquisition of surface rates. This is often not achievable with conventional well testing without the additional reservoir stimulation that is generally not available on remote wells.

For exemplary purposes, the present disclosure may refer to a job performed in a gas field located on the Gydan Peninsula, which is a geographical feature of the Siberian coast in the Russian Federation. Gas reservoirs of such field are confined to the Pokurskaya and Tanopchinskaya formations, which are represented by sandstones of varying shaliness and that, in turn, lead to a significant variation in porosity and permeability properties, even within the same reservoir. The presence of multilayered reservoirs with multiple fluid contacts and largely varying properties makes it reasonable to use a WFT for evaluation of such formations to characterize each reservoir separately and to determine the formation pressures, mobilities, saturations, and fluid contacts of the formations, as well as to capture downhole samples of reservoir fluids.

The testing approach introduced herein was trialed in one of the first exploration wells in Gydan Peninsula gas field, which was drilled in the edge of the reservoir to confirm gas reserves, and that penetrated six target formations. Each reservoir was tested within one logging run despite a large variation of porosity and permeability properties.

As the result of the job, unknown geological objectives and uncertainties were successfully resolved. The execution was divided into three parts: formation pressure and mobility profiling with express-pressure tester on cable, DFA and sampling with a radial focused probe, and DTT with a dual packer system.

In total, six productive zones were tested. Challenges during such testing included the wide range of permeability variation, from 0.3 millidarcy/centipoise (md/cP) to 300 md/cP, and the fact that some zones had fluid contacts. Precise characterization of zones close to the contacts was done based on pressure gradients and DFA.

The ORA WTF was deployed in one of the first wells. The advanced technical differentiators of the ORA WTF platform played significant role in the success of the operations, including:

- Downhole pumps that permit flow rates from 0.1-200 cubic centimeters per second ($cm^3$/sec) and transient testing in a wide range of conditions, including very high permeability formations and formations containing gas;
- A dual packer system that permits the straddling of complex formations, including dual inlets and a packer spacing of 1.6-15 meter (m), as well as the option of using the wellbore annulus as a downhole separator for immiscible fluids;
- A focused radial probe that permits fast DFA and clean fluid samples in most ranges of permeability;
- A sample carrier that permits representative, zero-dead-volume sample capture;
- A fluid analyzer that offers laboratory-accuracy in downhole measurements, including detailed definition of hydrocarbon composition ($C_1$, $C_2$, $C_3$, $C_4$, $C_5$, $C_{6+}$, and $CO_2$) with the ability to monitor the flow in both flowlines (e.g., one flowline per inlet);
- A calibrated induction resistivity sensor that permits accurate resistivity and salinity measurements in-situ; and/or
- Dual flow architecture, advanced electronics, and material selection means that permit the ORA WFT to be significantly shorter and lighter than other formation testing platforms, thereby reducing conveyance risk and increasing the scope for formation testing operations in challenging wellbores.

The following description regards a few examples that demonstrate results gained from the ORA WFT in real-world use. In a first example, the radial focused probe was used in the formation below the gas-water contact to collect clean samples of formation water. Because the well was drilled with water-based mud (WBM), obtaining clean formation water samples with conventional sampling tools was challenging, especially in the intervals with low to medium mobility. In an example of DFA, with a sampling station in the water zone with mobility of 5.9 md/cP, a volume of 508 liters (L) of fluid was pumped out of the formation in 3.3 hours. As a result, a formation water sample with about 1% of contamination by WBM filtrate was acquired. For comparison, conventional sampling technologies without focused sampling in similar downhole and formation conditions with mobility of 5.5 md/cP permit pumping 226 L in 5.2 hours, with contamination of about 80%.

Another example is related to the calibrated resistivity sensor, which, in combination with fast cleanup, permits direct downhole measurement of formation water salinity. During the current job, water salinity was measured in two nearby zones and detected a decrease of 1.4 g/l with the depth. This information was used in real time to fine-tune the saturation model. The dual packer system with extended spacing and the wide range of performance of the downhole pumps permitted achieving stable gas flow in zones with mobility as low as 0.4 md/cP. Despite the large interval volume of 160 L, the flow of gas was observed 30 minutes after cleanup began. Downhole pumps permitted pumping with a flow rate of 80 $cm^3$/sec at a differential pressure of more than 100 atmospheres (atm).

The ORA WFT pump also permitted pumping 3-5 times more volume of fluid than was possible with previous wireline formation testers. During this job, the total volume of fluid pumped during one descent was more than 10,000 L.

In summary, the technology achieved measurable increases in efficiency over previous technology, including:

- Miscible fluids cleanup being 3-5 times faster with the focused radial probe compared to legacy, non-focused technology;
- Flow managers with a wide range of dynamic flow rate permitting efficient operation with formation mobilities from 0.3-300 md/cP, including acquiring much larger volumes of formation fluid; and/or
- New hardware for DTT permitting operating in challenging borehole conditions.

Despite the significant amount of information obtained with WFT in open hole, most of the experimental wells were also tested in cased hole for a more accurate assessment of reservoir properties and reservoir productivity. The ORA WFT can aid in estimating reservoir parameters, assessing productivity, and estimating reserves at the early stages of well construction, and thereby be utilized to optimize the testing program in cased hole.

The diverse permeability estimation of the present disclosure may be utilized with techniques for different depths of investigation, ranging from core measurement to well testing. The DTT technique of the present disclosure was developed to bridge the gap between transient testing with legacy WFT and drill stem testing (DST). DTT offers an estimation of permeability at a larger depth of investigation in comparison to core measurements, log measurements, and legacy WFT platforms at a fraction of the time and cost of the conventional well testing.

The ORA WFT is capable of performing DTT and also has several advantages compared to legacy WFT platforms, including, but not limited to:

- High performance downhole pumps, with wide flow rate capabilities (maximum up to 17.3 m3/d at downhole conditions) that provide sufficient pressure disturbance at the sandface, even in reservoirs with high permeability;
- A set of specialized downhole equipment, including a circulation sub, a cable side entry sub, and reinforced housings with dual flowline architecture for power and telemetry subsystems, that permits pumping out formation fluid from the isolated interval while simultaneously circulating drilling mud, blending formation fluid and drilling mud in the circulation sub, and moving the mixture in a controlled manner to surface; and/or
- Technology aimed at minimizing noise levels to reduce the effect on data quality during transient testing, such as a single-crystal, dynamically compensated quartz gauge, downhole automatic and simultaneous shut-in for the dual inlet dual packer module when the downhole pumps stop, and a slip joint for drill pipe temperature expansion and contraction compensation.

The above features permit pumping safer and longer at high flow rates, thereby increasing the depth of investigation up to five times compared to pressure transient testing with legacy WFT tools. DTT according to one or more aspects of the present disclosure may also permit confident estimations of far-field permeability and zonal deliverability, which, in conjunction with downhole and surface hydrocarbon production, comprehensive DFA, and clean formation fluid downhole and surface samples, complies with local regulations to prove hydrocarbon reserves. At the same time, it is possible to perform several DTTs in different intervals of the well during a single formation testing descent.

DTT design according to aspects of the present disclosure may start with a series of simulations and modeling in different software. For given formation characteristics, a range of skin and anticipated formation fluid properties and the most effective flowing sequence and shut-in duration for pressure buildup may be determined to achieve geological objectives and, at the same time, define optimal mud circulation rate for wellbore stability over the entire test time. The DTT sequence may include the following stages:

- The WFT is conveyed downhole on drill pipe. After the dual-inlet, dual-packer system is positioned and set across the zone of interest, a short initial flow is performed for accurate formation pressure measurement and mobility estimation. This is followed by slip joint activation and wellbore isolation with the annular or ram BOP;
- After the wellbore is isolated, a first flow period (cleanup flow) is initiated with a volume of formation fluid sufficient to reduce contamination to a predetermined threshold, followed by a pressure buildup transient sufficiently long to identify radial flow and wellbore skin;
- Thereafter, a longer-duration main flow period produces a larger volume of formation fluid and, therefore, deeper investigation into the reservoir-after shut-in, the main pressure buildup is recorded; and/or.
- The wellbore is cleaned up of hydrocarbons. Optionally, considering the large volume of produced formation fluid, ultraclean fluid samples may be collected for laboratory PVT analysis. Thereafter, the BOP is opened and the WFT is moved to the next testing depth.

FIG. 1 is a schematic view of at least a portion of an example implementation of a DTT sequence, including a cumulative WFT pumps flow rate (e.g., $c^3$/sec) 110 depicted by dashed lines, a fully open choke manifold position 120 depicted by a dashed-dot-dot line, and a cumulative mud pumps flow rate (e.g., $c^3$/sec) 130 depicted by solid lines, as well as a pretest 140, an initial cleanup phase 150, a series of step rate flows 160, an initial pressure buildup transient phase 170, a main DTT flow period 180, and a main buildup phase 190. During the DTT, the formation fluid and mud mixture is elevated to the wellbore surface via the well annular space up to the BOP, where it is redirected via a choke line and choke manifold (e.g., as part of an automated pressure control system) to a rig mud gas separator (e.g., poor boy degasser). Thereafter, degassed mud is returned back to a drilling mud pit and reused (e.g., pumped back into the wellbore). At the same time, gas separated from the mixture is vented to the atmosphere. During a preparation phase of the described reservoir testing operations, the DTT technique of the present disclosure may utilize the gas separated by the separator to measure the surface production rate, and a large-volume surface gas sample may be collected and flared, similar to as may be performed during conventional well testing operations and which may be required by local regulators for reserves booking.

Figure 2:
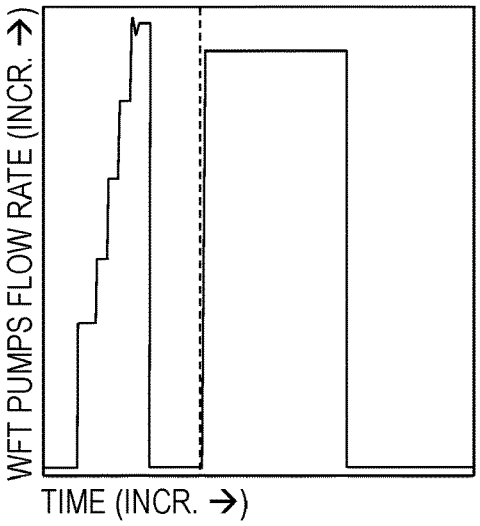
FIGS. 2-9 are graphs depicted selected outputs from a liquid and gas simulation according to one or more aspects of the present disclosure.
Figure 4:
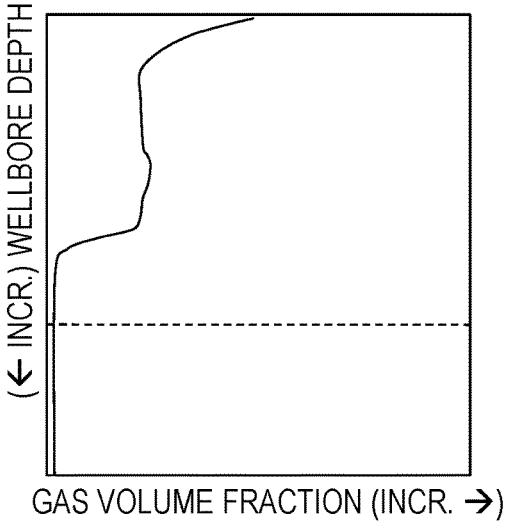
Figure 3:
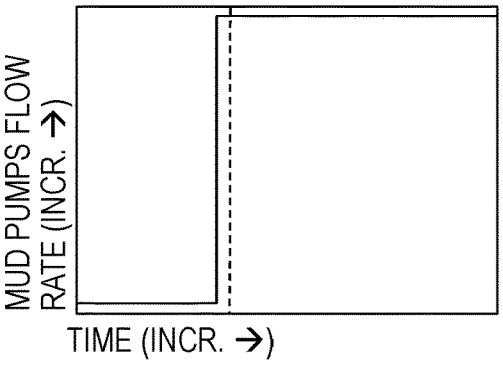
Figure 5:
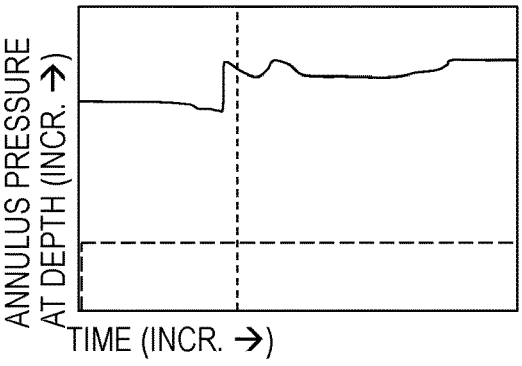
Figure 6:
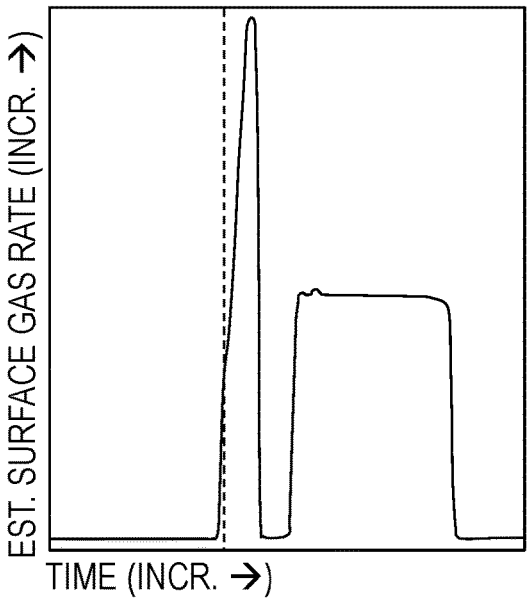
Figure 8:
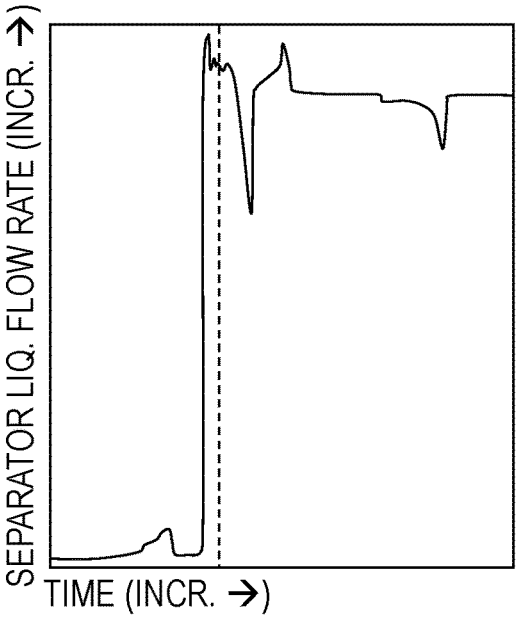
Figure 7:
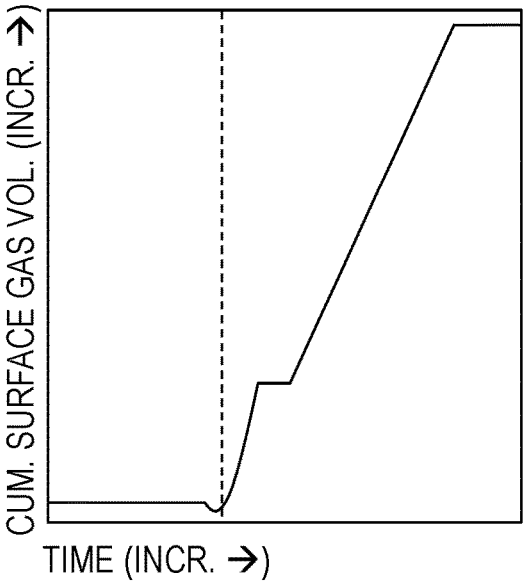
Figure 9:
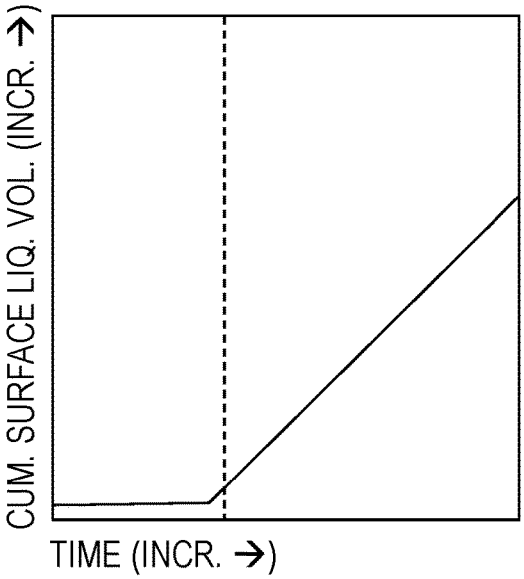

To estimate surface gas volume and production rates that can be obtained during DTT, a simulation can be conducted via a wellbore dynamics software package that permits simulating liquid and gas behavior in the wellbore during shut-in periods and while circulating drilling mud. Parameters can then be estimated based on simulation results, including: fluid migration velocity in the wellbore with and without drilling mud circulation; and mud column hydrostatic pressure behavior along the wellbore at any moment during the test, which can be utilized for safe operations throughout duration of the test. The PVT model of formation fluid can be used as one of the input parameters for such estimates. The volumes and expected surface production rates for liquid and gas can be estimated at various mud pump rates, wellhead pressure behavior, etc. FIGS. 2-9 depict selected example output parameters from the example of liquid and gas dynamics simulation. For example, among other possible output parameters from the example of liquid and gas dynamics simulation, FIG. 2 depicts the combined flow rate of the dual WFT pumps versus time (e.g., converted into standard conditions); FIG. 3 depicts the cumulative rate of the drilling rig mud pumps versus time; FIG. 4 depicts gas volume fraction in the wellbore annulus versus depth at a specific time (any time may be displayed); FIG. 5 depicts hydrostatic pressure in the wellbore annulus at a specific depth (any depth may be displayed) versus time; FIG. 6 depicts estimated gas rate at surface versus time; FIG. 7 depicts cumulative gas volume at surface versus time; FIG. 8 depicts liquid flow rate from the separator (drilling mud and liquid hydrocarbons) versus time; and FIG. 9 depicts cumulative liquid volume from the separator versus time.

The job design for DTT can be optimized based on the above-described, transient flow modeling results, and may permit achieving both downhole and surface objectives by considering limitations in time given per zone of interest. The modeling may also show the need for a specific separator at the surface, such as may be operated at a higher pressure (e.g., 6 to 10 atm) to efficiently manage the surface flow by measuring the flow rates, obtaining pressurized PVT samples, and flaring the gas.

Standard mud degassers conventionally used to discharge fluid from a BOP have a low working relative pressure, such as about 0.72 atm, and may thus be used just to separate the main portion of gas for further venting into the atmosphere. However, this limitation in working pressure may not permit obtaining 100% efficient separation, nor installing a metering device at the gas line due to creation of backpressure, thus preventing obtaining pressurized samples. However, mobile surface testing with a three-phase separator can be an alternative solution for separation of liquid and gas coming from the annulus. Such a mobile surface testing package may permit:

- Gas and drilling mud to be separated continuously during operations, perhaps including separating the condensate accumulated on top of drilling mud;
- Pressure to be controlled at the separator for efficient separation by minimizing the liquid carryover into the gas line and for sending drilling mud into the rig circulation system;
- Measuring the gas rate;
- Pressurizing gas and liquid hydrocarbons to be sampled for laboratory analysis;
- Obtaining gas samples for express wellsite analysis for estimation of gas specific gravity, $H_2S$, and $CO_2$ content; and/or
- Safely and efficiently flaring gas.

The surface flow dynamics can be modeled in a special software using the results of the above-described transient modeling in a wellbore as input to select equipment for surface testing by defining the size of pipeline network, the necessary minimum pressure and liquid level at the separator for effective separation, and the size of the pressure control valve at gas line. In the example described above, the calculation may result in:

- The surface pipeline network diameter being 89 millimeters (mm);
- A horizontal, three-phase separator with a length of 3.1 m and diameter of 0.91 m, with an oil section weir located two m from the separator inlet;
- A pressure control valve diameter less than 50.8 mm, with an orifice diameter for gas rate measurements ranging from 12.7 to 19.5 mm;
- A minimum liquid level at the separator of 50% of the diameter at the middle; and/or
- A minimum required setting pressure at the separator of six atm, although before getting the gas at surface, the separator may be pressurized with nitrogen to six atm to push the drilling mud into the rig's system.

Despite routine application of the mobile surface testing package for well cleanups and flowbacks, its deployment for DTT can be challenging due to:

- High content of solids in the drilling mud;
- High liquid rate (e.g., 600 to 1200 $m^3/d$) during circulation;
- Possible gas slugs at surface;
- Low gas to liquid ratio (1-3 $m^3/m^3$) in a flowing mixture; and/or
- Low condensate fraction in a liquid (0.001 to 0.01 $m^3/m^3$).

Standard three-phase horizontal separators used to handle high liquid rates (e.g., up to 1600 $m^3/d$) may usually be designed for high gas rate. However, a low gas rate measurement with such separator can be difficult due to inability to accurately control the pressure in a large-diameter gas line. This challenge can be overcome by adding an automated pressure control system and a Daniel orifice plate metering device into a gas line designed for low gas rates.

Figure 10:
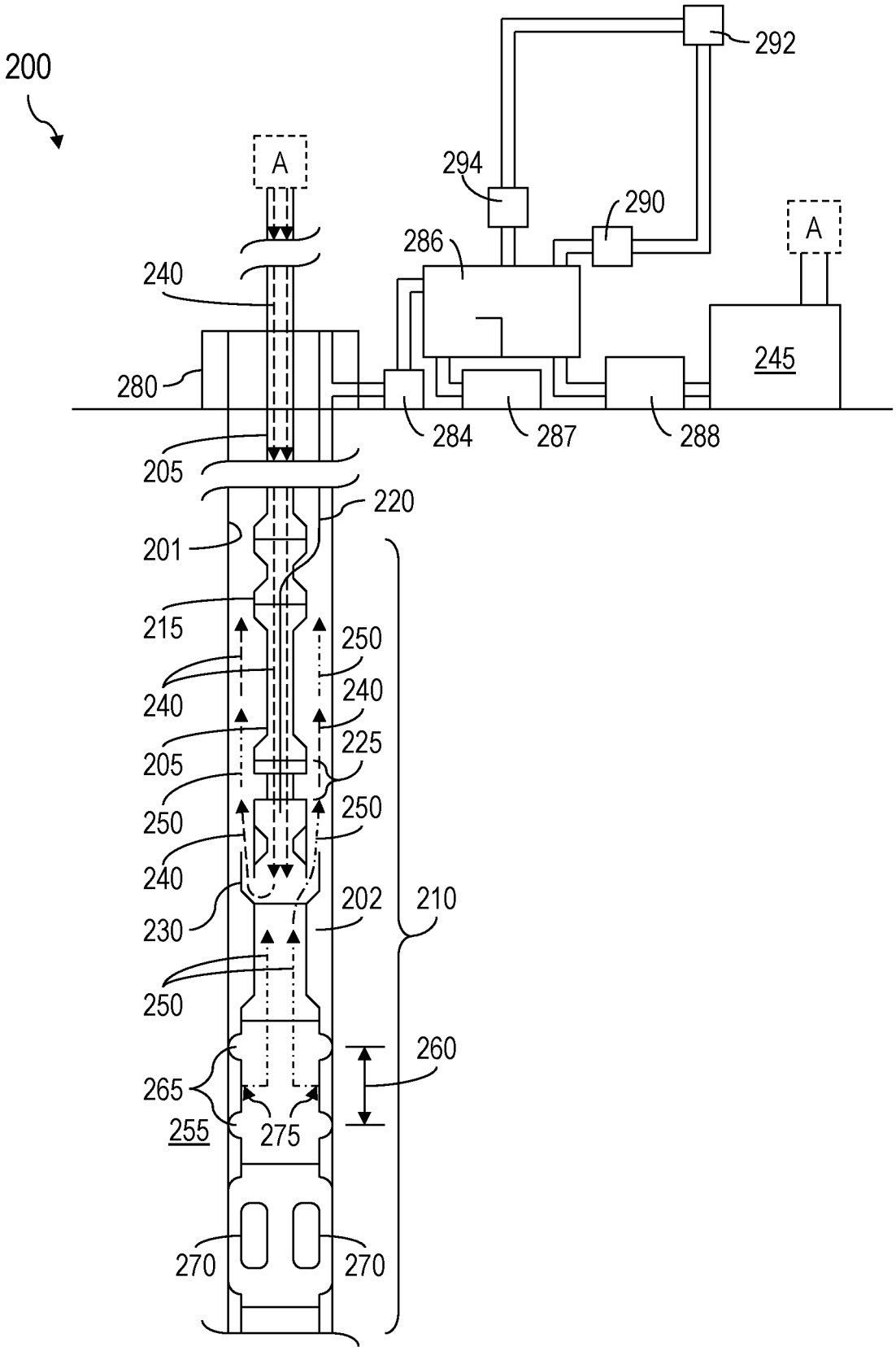
FIG. 10 is a schematic view of at least a portion of an example implementation of a system and process flow for performing DTT according to one or more aspects of the present disclosure.

For example, FIG. 10 depicts a schematic view of at least a portion of an example system 200 for DTT according to one or more aspects of the present disclosure. The system includes a WFT 210 (e.g., the above-described ORA WFT) conveyed via drill pipe 205 in a wellbore 201. The WFT 210 may include a cable side entry sub 215 permitting a wireline cable 220 from wellsite surface equipment (not shown) to enter into the drill pipe 205, as well as a slip joint 225 operable to compensate for temperature-dependent expansion and contraction of the drill pipe 205 during at least the DTT. The WFT 210 may also include a circulation sub 230 by which drilling fluid 240 (indicated in FIG. 10 by long dashed lines) pumped into the drill pipe 205 from one or more surface-located mud pumps 245 is blended with formation fluid 250 (indicated in FIG. 10 by dashed-dot lines)

pumped by the WFT 210 through dual inlets 275 from the formation 255 into an interval 260 of an annulus 202 defined between the WFT 210 and a sidewall of the wellbore 201. The interval 260 is isolated by straddle packers 265 of the WFT 210. A spacing of the straddle packers 265 spans across a zone of interest (vertically encompassed by the interval 260) of the formation 255. The spacing of the straddle packers 265 may be 1.6-15.0 m. The WFT 210 may also (or instead) comprise a radial focused probe comprising a plurality of focused probe inlets 270 operable for pumping formation fluid from around a circumference of the wellbore 201.

The system 200 also includes a BOP 280 which directs the blended fluids 240/250 received from the WFT 210 to an automated pressure control system (e.g., such as may comprise an automated choke) 284.

Four reservoir zones were evaluated with the DTT methodology described above. Each reservoir test was conducted by isolating the interval 260 with straddle packers 265. Each test consisted of an initial (cleanup) flow period to obtain surface pressurized gas samples and am initial main buildup period that reached the infinite-acting radial flow regime. The present disclosure considers two examples for high- and low-permeability reservoirs saturated with gas. Each DTT included a dual packer setting stage, pretest, activation of slip joints, BOP closure, first flow period (cleanup), initial buildup, main flow with recirculation of drilling mud, main buildup, unsetting the straddle packers, and moving the WFT to the next zone of interest. Downhole parameters and optical fluid analyzer data were obtained during testing of each reservoir. The quality of transient test data was good, and buildup interpretation results permitted achieving the geological objectives of the reservoir testing by quantifying the dynamic properties of the reservoirs.

In total, 2.3 $m^3$ of downhole gas volume was extracted from the interval during the DTT service. The pumped fluid, after mixing with drilling mud, was circulated up to a surface separator 286, where solids/particulates were separated and directed into a container 287, liquids were separated into a tank 288, and gas was separated and sent to a flowmeter 290 for gas flow rate measurements and subsequent disposal via a flare 292. The flowmeter 290 may comprise a Daniel orifice plate metering device and/or other metering devices. The measured surface parameters included wellhead pressure (before choke system 284), pressure and temperature of the separator 286, and gas flow rate with cumulative volume on the surface (via the flowmeter 290). The gas was acquired on the surface about two hours after starting the drilling mud circulation, which was as expected from the initial DTT design. The gas separation and subsequent flow rate measurements were performed during about fifteen hours of fluid flow up to the surface. The key surface parameters from a high-permeability zone were:

Accumulated surface gas volume was 400 $m^3$;

Average gas flow rate ranged from 1870 to 1990 $m^3$/d;

Gas temperature in the separator was 13 to 14° C.; and

Gas pressure in the separator was 8 to 9 atm.

Moreover, after acquiring the fluid flow on the surface, gas samples were collected via sampling means 294 to estimate the specific gravity and $H_2S$ content of the gas. As a result, the gas specific gravity was 0.589 (see Table 1) without any amount of $H_2S$. As the stable gas flow rate was reached, 20 L of gas sample was also taken under the pressure for the subsequent PVT analysis. After the surface measurement, the gas was effectively burnt via the flare 292.

TABLE 1

Gas specific gravity measurements during DTT in a low-permeability zone.

| Time | Gas Specific Gravity |
|---|---|
| 03:36 | The flow was directed to the separator |
| 03:57 | 0.912 |
| 04:03 | 0.82 |
| 04:09 | 0.722 |
| 04:19 | 0.608 |
| 04:30 | 0.588 |
| 04:39 | 0.579 |
| 04:57 | 0.565 |
| 05:04 | 0.561 |
| 05:10 | 0.562 |
| 05:22 | 0.564 |
| 05:28 | 0.562 |
| 05:38 | 0.558 |
| 06:00 | 0.554 |
| 06:42 | 0.558 |
| 07:00 | 0.558 |
| 07:36 | Start of gas sampling from the separator |
| 07:54 | End of gas sampling from the separator |
| 08:13 | 0.554 |
| 08:49 | 0.554 |
| 09:18 | 0.556 |

To estimate the zone productivity, the downhole measurements were combined with surface data, similar to traditional well test analysis. Downhole flow rates were not synchronized with surface rates due to the large wellbore storage and time required to get the gas on the surface during mud circulation. Thus, to compare the downhole gas rates with surface gas rates ones, a special volume factor was implemented that was calculated as accumulated gas volume at surface conditions divided by accumulated gas volume downhole. As a result, good matching was observed between gas rates measured on the separator and downhole rates recalculated to surface conditions. A gas formation volume factor (Bg) was also determined to be 0.00579, which was fairly close to the standard Bg (from PVT) for dry gas (0.0053).

The measured bottomhole pressure and downhole gas rates recalculated to surface conditions were used for interval pressure transient test (IPTT) analysis. The productivity index and absolute open flow potential (AOFP) were estimated by two methods:

The Darcy method, based on the reservoir properties obtained from the IPTT analysis; and The laminar inertial turbulent (LIT) method, based on average reservoir pressure $P_{res}$, bottomhole pressure $P_{flw}$, and gas flow $Q_g$ (e.g., average $(P_{res}^2-P_{flw}^2)/Q_g$ VS. $Q_g$).

The gas AOFP was evaluated in the range of 4500 to 6200 $m^3$/d from the two different approaches, indicating sufficient coincidence of the acquired results.

In total, 2.67 $m^3$ of downhole gas volume was extracted from the interval during the DTT service of a low-permeability zone. Selected surface parameters thereof included:

Accumulated surface gas volume of 422 $m^3$;

Average gas flow rate of 1600 to 1800 $m^3$/d;

Gas temperature in the separator was 10 to 11° C.; and

Gas pressure in the separator was 7 to 8 atm.

After acquiring the fluid flow on the surface, gas samples were collected to estimate their specific gravity and $H_2S$ content. The gas specific gravity was 0.553 (see Table 2) without any amount of $H_2S$. As the stable gas flow rate was reached, 20 L of gas sample was also taken under the pressure for the subsequent PVT analysis.

TABLE 2

Gas specific gravity measurements during DTT in a high-permeability zone.

| Time | Gas Specific Gravity |
|---|---|
| 15:14 | The flow was directed to the separator |
| 16:40 | 0.558 |
| 16:56 | 0.552 |
| 17:09 | 0.552 |
| 17:28 | 0.552 |
| 17:49 | Start of gas sampling from the separator |
| 18:20 | End of gas sampling from the separator |
| 18:29 | 0.553. |
| 19:09 | 0.553 |
| 20:08 | 0.553 |
| 20:49 | 0.554 |
| 21:20 | 0.554 |
| 22:12 | 0.557 |
| 22:18 | 0.558 |

From the measured gas volumes at the bottomhole and at the wellhead, the gas volumetric coefficient Bg was determined to be 0.00633. Comparison of the calculated surface gas rate at wellhead conditions with the results of gas flow rate measurements at the separator also showed good correspondence.

The AOFR was estimated to be in the range of 1.106 to 1.126 million $m^3$/day.

Obtaining representative information on the hydrodynamic parameters of the reservoir in an open hole can significantly optimize the cased hole well-testing program and reduce the construction time of an exploration well. Improving the efficiency of reservoir testing is an important criterion for offshore exploration drilling and for remote onshore drilling in multilayer formations. In some cases, if well testing will be conducted in an environmentally sensitive area, where, for example, gas/oil flaring is prohibited or emissions reduction is required, this technology is unique for obtaining reservoir hydrodynamic parameters.

The conventional methodology for assessing the reservoir potential according to the data of traditional WFT assumes the IPTTs are done at several points of the productive formation. After that, the permeability curve, which is usually calculated permeability depending on porosity and obtained from the cores, is corrected for the results of IPTTs. Next, a well sectoral hydrodynamic model is built with the hydrodynamic simulator, which uses the basic reservoir properties and a fluid model (PVT properties and positions of fluid contacts). Such model also considers data of the skin and rate-dependent skin. Nevertheless, the results of calculating potential production rates using this method can be validated against the results of cased hole well testing, which is an additional justification for the validity of this approach.

Using the above-described methodology, in wells drilled offshore and in multilayer formations, cased hole well-testing is carried out in just a few objects. In the remaining formations, production rates are estimated using such methodology, assuming IPTTs were carried out in enough quantity to correct the permeability of the formations.

However, productivity of the formation can be assessed using the results of DTTs as introduced herein. The essence of the approach is to use such results as input parameters for building a hydrodynamic model. Thus, having bottomhole pressures, calculated wellhead flow rates according to the method described above, and log data and the position of fluid contacts, the existing geological and hydrodynamic model of the reservoir or the field can be updated and adjusted within the sectoral model to DTT results. In other words, DTT can, in certain cases, serve as an alternative to traditional cased hole well testing.

The ORA WFT permits obtaining comprehensive information about reservoir pressures, saturation, and fluid contacts in extremely difficult geological and technical conditions, which was a difficult task for the previous generation of WFT. The ORA WFT also has the ability to flush the well without unlatching the wireline cable and pulling tools out of the hole, saving a significant amount of time when testing multilayer formations with a wide range of permeabilities.

The reservoir testing methodology introduced herein will significantly save time for assessing reserves, especially in multilayer formations, where it is often not economically feasible to test some reservoirs in a cased hole. This, in turn, will affect the rapidity of obtaining the first commercial production of a field.

The considered concept of integral hydrodynamic modeling permits forecasting productivity of the formation as a whole and to analyze the effect of various parameters on production, thereby permitting the selection of an optimal well completion design.

Figure 11:
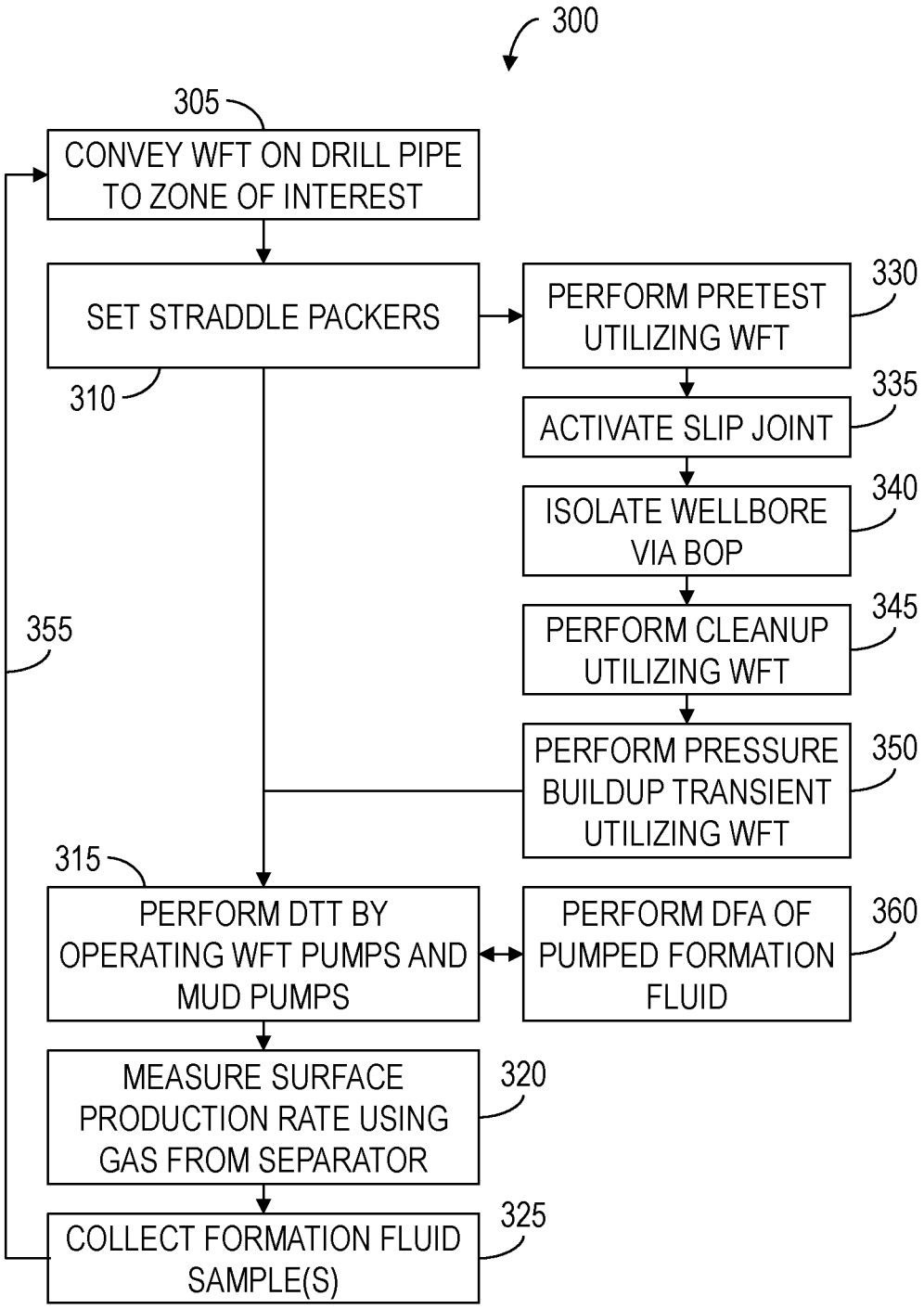
FIG. 11 is a flow-chart diagram of at least a portion of an example implementation of a method according to one or more aspects of the present disclosure.

In view of the entirety of the present disclosure, including the figures and the claims, a person having ordinary skill in the art will readily recognize that the present disclosure introduces a method comprising (as shown in the example method 300 depicted in FIG. 11): (A) conveying (305) a WFT via drill pipe within a wellbore penetrating a subterranean formation; (B) setting (310) two packers of the WFT on opposite sides of a zone of interest of the formation, thereby isolating an interval of an annulus between the WFT and a wall of the wellbore; (C) performing (315) DTT of the formation by: (i) operating two WFT pumps of the WFT to pump fluid from the formation via the isolated interval, through the WFT, and out of the WFT to the wellbore; and (ii) operating mud pumps to pump drilling mud into the wellbore and thereby convey a mixture of the drilling mud and the pumped formation fluid through the annulus to a mud gas separator located at a wellsite surface from which the wellbore extends; and (D) using (320) gas separated by the mud gas separator to measure a surface production rate of the formation fluid.

The method (300) may also comprise collecting (325) samples of the formation fluid at or after an end of the deep transient testing.

The method (300) may also comprise, prior to performing the deep transient testing: performing (330) a pretest by operating the WFT pumps to pump fluid from the formation while sensing parameters of the pumped formation fluid to measure pressure of the formation and estimate mobility of the formation; after performing the pretest, activating (335) a slip joint operable to compensate for temperature-dependent expansion and contraction of the drill pipe during at least the deep transient testing; after activating the slip joint, isolating (340) the wellbore via operation of a BOP; after isolating the wellbore via the BOP, operating (345) the WFT pumps to pump a volume of fluid from the formation sufficient to reduce contamination of the pumped fluid to a predetermined level; and after sufficiently reducing contamination, operating (350) the WFT pumps to perform a pressure buildup transient sufficiently long to identify radial flow of fluid from the formation and a wellbore skin. In such implementations, among others within the scope of the present disclosure, the method (300) may further comprise opening the BOP, then moving the WFT to another zone of interest, then repeating the deep transient testing and the surface production rate measurement, as symbolized in FIG. 11 by arrow 355.

The method (300) may also comprise performing downhole (360) fluid analysis of the pumped formation fluid during the deep transient testing. The downhole fluid analysis may comprise measuring, estimating, or determining one or more of pressure, contamination, gas-to-oil ratio, mass density, optical density, formation volume factor, viscosity, resistivity, fluorescence, American Petroleum Institute (API) gravity, and composition of the pumped formation fluid. Measuring, estimating, or determining the composition of the pumped formation fluid may comprise measuring, estimating, or determining an amount or percentage of one or more hydrocarbons in the pumped formation fluid, including one or more of $CO_2$, $C_1$, $C_2$, $C_3$, $C_4$, $C_5$, and $C_{6+}$.

Figure 12:
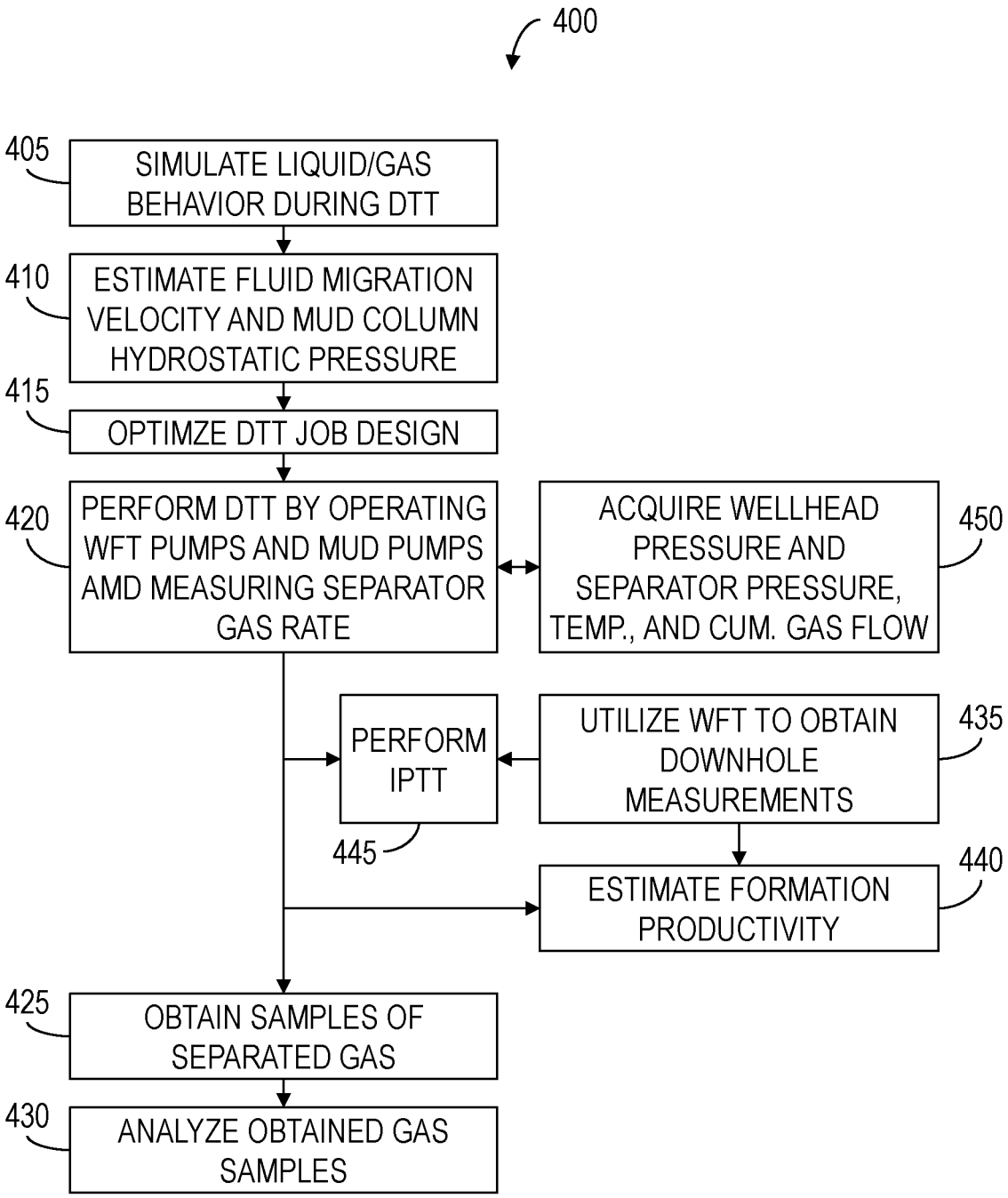
FIG. 12 is a flow-chart diagram of at least a portion of another example implementation of a method according to one or more aspects of the present disclosure.

The present disclosure also introduces a method comprising (as shown in the example method 400 depicted in FIG. 12): (A) utilizing a wellbore dynamics simulation to simulate (405) liquid and gas behavior in a wellbore during a contemplated DTT of a subterranean formation penetrated by the wellbore, wherein the contemplated DTT utilizes a WFT in the wellbore and a three-phase separator at a wellsite surface from which the wellbore extends, and wherein the simulated liquid and gas behavior in the wellbore includes during shut-in periods of the DTT and during drilling mud circulation periods of the DTT; (B) utilizing results of the wellbore dynamics simulation to estimate (410): (i) fluid migration velocity in the wellbore with and without drilling mud circulation; and (ii) mud column hydrostatic pressure behavior along the wellbore at any moment of the test; (C) optimizing (415) a job design for the contemplated DTT based on the wellbore dynamics simulation results, the estimated fluid migration velocity, and the estimated mud column hydrostatic pressure behavior; and (D) performing (420) the DTT by simultaneously: (i) utilizing the WFT to pump fluid from the formation; (ii) utilizing mud pumps at the wellsite surface to pump drilling mud into the wellbore and, thereby, pump a mixture of the formation fluid and the drilling mud to the three-phase separator; and (iii) measuring gas rate obtained from the three-phase separator.

The method (400) may also comprise utilizing the three-phase separator during the DTT to obtain (425) samples of the separated gas and analyzing (430) the obtained gas samples to estimate: specific gravity of the gas; an existence or amount of H2S in the gas samples; and an amount of CO2 in the gas samples.

Optimizing the job design for the contemplated DTT may comprise selecting surface equipment and parameters to be utilized for the contemplated DTT, including: surface pipeline network size; minimum pressure and liquid level at the separator for effective separation and, based thereon, a physical configuration of the separator; and gas line pressure control valve size. The selected surface equipment to be utilized for the contemplated DTT may further comprise an automated pressure control system and a Daniel orifice plate metering device.

The method (400) may also comprise: operating the WFT to obtain (435) downhole measurements; and estimating (440) productivity of a zone of interest of the formation based on the measured gas rate and the downhole measurements. For example, the downhole measurements may include bottomhole pressure, and the method (400) may further comprise performing (445) an IPTT analysis utilizing the bottomhole pressure measurements and the measured gas rate.

Performing the DTT testing may further comprise acquiring (450): wellhead pressure; separator pressure and temperature; and cumulative gas flow volume from the separator.

The wellbore dynamics simulation results may comprise: downhole pump flow rate versus time; drilling rig pump rate versus time; gas volume fraction in an annulus of the wellbore versus depth at specific times; hydrostatic pressure in the annulus at specific depths versus time; estimated gas rate at surface; cumulative gas volume at surface; liquid flow rate at a mud gas separator, wherein the liquid flow rate accounts for drilling mud and liquid hydrocarbons; and cumulative liquid volume at surface.

The present disclosure also introduces a system (such as the example implementation shown in FIG. 10) for performing DTT of a subterranean formation penetrated by a wellbore, the system comprising: a WFT conveyable in the wellbore via drill pipe and operable to pump formation fluid from the formation during the DTT; and a multiphase flowmeter located at a wellsite surface from the wellbore extends and operable to measure gas flow rate of a fluid mixture output from the wellbore during the DTT.

The system may further comprise mud pumps located at the wellsite surface and operable to pump drilling mud into the wellbore, such that the fluid mixture output from the wellbore during the DTT is a combination of the drilling mud pumped by the mud pumps and the formation fluid pumped by the WFT.

The WTF may be operable during the DTT to: isolate an interval of an annulus defined between the WTF and a wall of the wellbore; pump formation fluid from the formation via the isolated interval while simultaneously circulating drilling mud pumped into the wellbore by mud pumps located at the wellsite surface; blend the formation fluid and the drilling mud in a circulation sub; and move the blended formation fluid and drilling mud through the annulus to the wellsite surface.

The WFT may comprise straddle packers operable to be set on opposing sides of a zone of interest of the formation examined by the DTT, wherein the straddle packers may have a spacing between 1.6 meters and 15 meters.

The WFT may comprise a focused radial probe for obtaining noncontaminated samples of the formation fluid.

The WFT may comprise: a downhole fluid analyzer operable to determine hydrocarbon composition of the formation fluid; and an induction resistivity sensor operable for measuring resistivity and salinity of the formation.

The abstract at the end of this disclosure is provided to permit the reader to quickly ascertain the nature of the technical disclosure. It is submitted with the understanding that it will not be used to interpret or limit the scope or meaning of the claims.

What is claimed is:

1. A method comprising:

conveying a wireline formation tester (WFT) via drill pipe within a wellbore penetrating a subterranean formation;

setting two packers of the WFT on opposite sides of a zone of interest of the formation, thereby isolating an interval of an annulus between the WFT and a wall of the wellbore;

performing a pretest by operating two WFT pumps of the WFT to pump fluid from the formation while sensing parameters of the pumped formation fluid to measure pressure of the formation and estimate mobility of the formation;

after performing the pretest, activating a slip joint operable to compensate for temperature-dependent expansion and contraction of the drill pipe during at least deep transient testing;

after activating the slip joint, isolating the wellbore via operation of a blowout preventer (BOP);

after isolating the wellbore via the BOP, operating the two WFT pumps to pump a volume of fluid from the formation sufficient to reduce contamination of the pumped fluid to a predetermined level;

after sufficiently reducing contamination, operating the two WFT pumps to perform a pressure buildup transient sufficiently long to identify radial flow of fluid from the formation and a wellbore skin; and after performing the pressure buildup transient, performing the deep transient testing of the formation by:

operating the two WFT pumps of the WFT to pump fluid from the formation via the isolated interval, through the WFT, and out of the WFT to the wellbore; and operating mud pumps to pump drilling mud into the wellbore and thereby convey a mixture of the drilling mud and the pumped formation fluid through the annulus to a mud gas separator located at a wellsite surface from which the wellbore extends; and using gas separated by the mud gas separator to measure a surface production rate of the formation fluid.

2. The method of claim 1 further comprising collecting samples of the formation fluid at or after an end of the deep transient testing.

3. The method of claim 1 further comprising performing downhole fluid analysis of the pumped formation fluid during the deep transient testing.

4. The method of claim 3 wherein the downhole fluid analysis comprises measuring, estimating, or determining one or more of pressure, contamination, gas-to-oil ratio, mass density, optical density, formation volume factor, viscosity, resistivity, fluorescence, American Petroleum Institute (API) gravity, and composition of the pumped formation fluid.

5. The method of claim 1 further comprising opening the BOP, then moving the WFT to another zone of interest, then repeating the deep transient testing and the surface production rate measurement.

* * * * *